US005437532A

United States Patent [19]

Kaczmarczyk et al.

[11] Patent Number: 5,437,532

[45] Date of Patent: Aug. 1, 1995

[54] CONTROL SYSTEM FOR LATCH THAT SECURES LOADER YOKE MEMBER TO TRACTOR FRONT-END WEIGHT BRACKET OR BUMPER

[75] Inventors: Edward T. Kaczmarczyk, Welland; Roger A. Noyes, Stevensville, both of Canada

[73] Assignee: Deere & Company, Moline, Ill.

[21] Appl. No.: 234,451

[22] Filed: Apr. 28, 1994

[51] Int. Cl.[6] ..... B66F 9/00

[52] U.S. Cl. ..... 414/686; 403/325; 292/139

[58] Field of Search ..... 414/686, 680; 403/8, 403/9, 53, 80, 83, 187, 321, 325; 292/137, 138, 139

[56] References Cited

U.S. PATENT DOCUMENTS 4,780,046 10/1988 Friesen et al. ..... 414/686
4,793,764 12/1988 Hamm ..... 414/686

FOREIGN PATENT DOCUMENTS 164235 7/1980 Netherlands ..... 414/686

*Primary Examiner*—Donald W. Underwood

[57] ABSTRACT

A tractor-mounted loader includes a yoke member having legs joined by a bight member that carries a latch that is L-shaped in cross section and is pivotally mounted for movement between a closed position, wherein a first leg of the latch extends generally horizontally above and is engaged with a front-end weight bracket of the tractor carrying the loader, and an open position wherein the first leg is located in a generally upright position forwardly of the bracket. A control rod extends along one of the legs of the yoke member and has its forward end connected to the latch so that rearward and forward shifting of the rod respectively moves the latch to and from its closed position. A cylindrical lock member is adjustably threaded onto the rear end of the rod and is received for movement along a slot provided in the a rear portion of the one yoke member leg and is dimensioned for fitting closely in an enlarged rear end portion of the slot to establish a locked condition in the rod which corresponds to the closed position of the latch. A necked down intermediate section of the lock member is movable into register with the slot to permit the latch rod to be moved forwardly to place the latch in its open position.

12 Claims, 3 Drawing Sheets

CONTROL SYSTEM FOR LATCH THAT SECURES LOADER YOKE MEMBER TO TRACTOR FRONT-END WEIGHT BRACKET OR BUMPER

BACKGROUND OF THE INVENTION

The present invention relates to attachment systems for securing loaders to tractor frames and more particularly relates to a latch system for attaching the bight of a loader U-shaped brace or yoke member to the tractor front-end weight bracket or bumper.

U.S. patent application Ser. No. 08/110,444 filed 23 Aug. 1993, now U.S. Pat. No. 5,388,950 granted on 14 Feb., 1995, assigned in part to the same assignee as is the instant application, relates to a latch system for attaching a loader to a weight bracket of a tractor, the latter serving as a support for the forward end of a U-shaped brace or yoke of the loader. In this latch system, a latch operating rod extends lengthwise through a tubular, fore-and-aft extending leg of the brace or yoke and has its forward end attached to an arm fixed to one side of a latch member mounted for pivotal movement about a horizontal transverse axis between latched and unlatched positions. The geometry of the latch operating rod and arm is such as to require the rod to be shifted forwardly to move the latch to its latched position and rearwardly to move the latch to its unlatched position.

This latch operating system has been found unsatisfactory. Because of its remote location, an operator is not able to visually discern whether or not the latch is latched and the latch may, in fact, not be latched when the rod is located in its forward, latch effecting position. This may happen because the latching force is delivered to the latch with the rod in compression resulting in the relatively long rod deflecting rather than transmitting motion to the latch when the latter is obstructed from moving freely to its latched position. Also, it is possible that the latch may in some way be contacted and forced open while the lever remains in its forward, latched position.

Although latch system designs are known which utilize a rod operating in tension to effect operation of the associated latch to its latched position, these systems have enough looseness in joints or have manufacturing tolerances in the various components thereof that the position of the latch rod is an unreliable indicator of latch position.

SUMMARY OF THE INVENTION

According to the present invention there is provided an improved latch operating system and, more specifically, there is provided latch operating system which is an improvement over that disclosed in U.S. application Ser. No. 08/110,444 filed 23 Aug. 1993 now U.S. Pat. No. 5,388,950 granted on 14 Feb., 1995.

A broad object of the invention is to provide a latch operating system which operates to positively place the latch in its latched position when the latch rod is in a preselected position corresponding to the latched position of the latch.

Yet another broad object of the invention is to provide a latch operating system designed such that the operator can reliably visually discern when the latch is in its latched position.

A further object of the invention is to provide a latch operating system including a latch rod which operates in tension to transmit a closing or latching force to the latch.

A more specific object of the invention is to provide a latch operating mechanism of a type including a rod extending beside a surface of a fore-and-aft extending loader frame member, the rod carrying a lock member at its rear end which is releasably held in a latched position at the rear end of a fore-and-aft extending slot provided in the loader frame surface, the latched position of the rod corresponding to the closed position of the latch and being visible to the operator.

Yet another specific object of the invention is to provide a latch operating mechanism as defined in the immediately preceding object wherein the slot has an enlarged rear end portion and wherein a cylindrical lock member includes a reduced diameter portion located between a mounting portion threaded onto the rear end of the rod and a locking portion selectively movable into the enlarged rear portion of the slot so as to hold the latch rod in its latched position, the reduced diameter portion permitting free movement of the lock member along the slot so as to permit the rod to be moved to its forward unlatched position corresponding to the unlatched position of the latch.

Still another specific object is to provide a latch operating mechanism as defined in the immediately preceding object wherein the slot also has an enlarged forward end portion and wherein the locking portion of the lock member is selectively movable into the enlarged forward end to retain the rod in its forward shifted, unlatched position corresponding to the unlatched position of the latch.

Another object of the invention is to provide a latch operating mechanism as set forth in the previous objects wherein a spring is associated with the lock member and resiliently resists movement of the latter from its rearward latched position.

These and other objects of the invention will become apparent from a reading of the ensuing description together with the appended drawings.

DESCRIPTION OF THE PREFERRED EMBODIMENT

Figure 1:
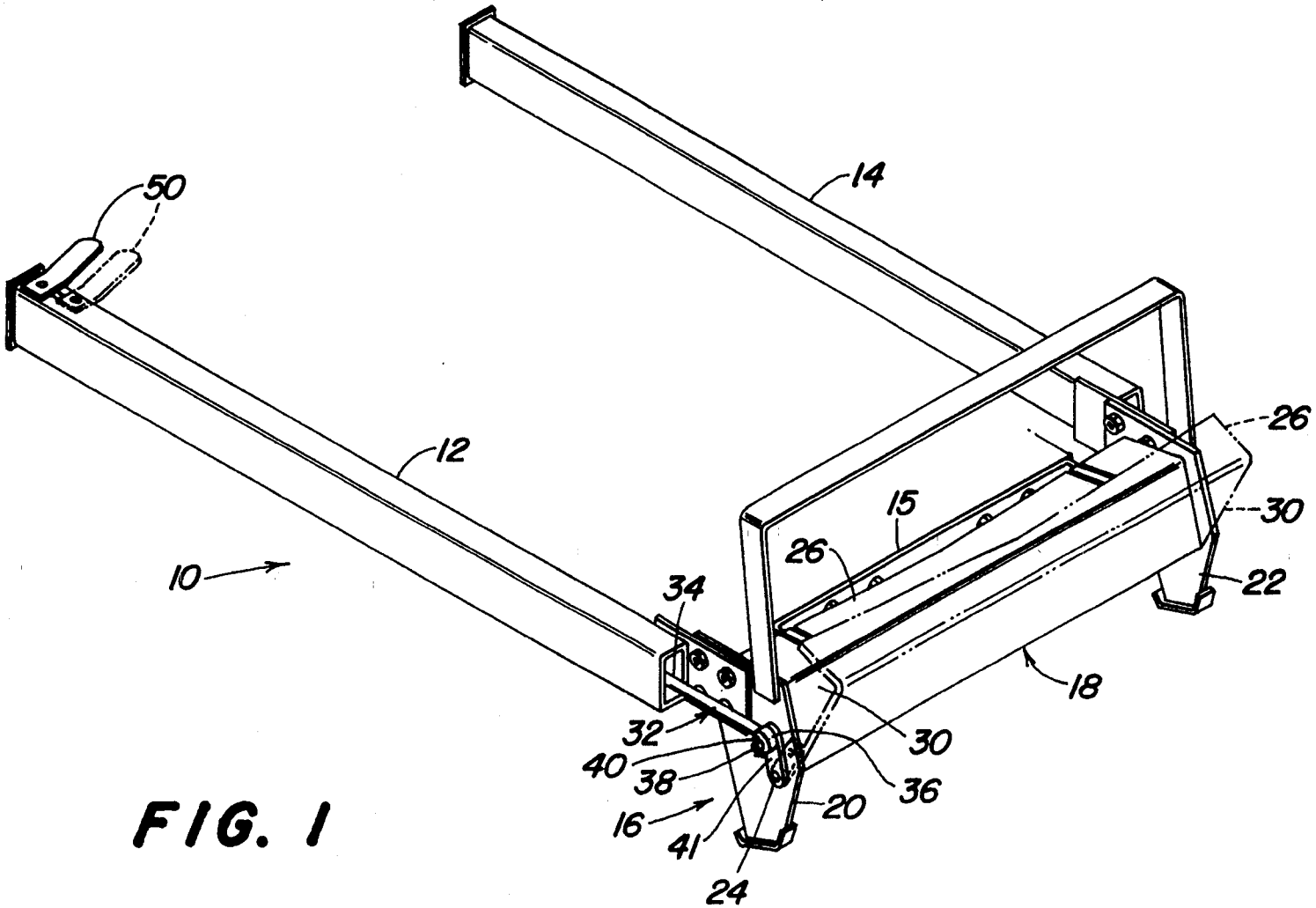
FIG. 1 is a somewhat schematic left front perspective view of a U-shaped yoke member of a loader embodying a latch mechanism constructed in accordance with the principles of the present invention and being shown in a solid line closed position and a dashed line open position.

Referring now to FIG. 1, there is shown a U-shaped loader mounting frame brace or yoke member 10 including right and left legs 12 and 14, respectively. The loader of which the yoke member 10 forms a part would normally include upright posts (not shown) welded to outer rear portions of the legs 12 and 14 and having lower ends mounted to supports at opposite sides of a tractor not shown except for a weight bracket 15 forming a forward end thereof. The yoke member 10 has a U-shaped bight portion 16 connected between forward ends of the legs 12 and 14, the bight portion 16 carrying a latch 18 extending between right and left upright plates respectively forming legs 20 and 22 thereof and being formed of a plate which is inverted L-shaped in cross section. The latch 18 is mounted for pivoting about a horizontal axis defined by axially aligned pivot pins located in the legs 20 and 22 of which only the right pin is visible at 24. The latch 18 is pivotable between a closed position, shown in solid lines, and an open position, shown in dashed lines. When in its closed position, a first leg 26 of the latch 18 extends horizontally over and engages top surfaces of the weight bracket 15 while a second latch leg 30 extends vertically in front of the bracket.

A latch-operating assembly 32 is provided for permitting the operator to rotate the latch 18 between its closed and open positions from a remote location adjacent the operator station of the tractor to which the yoke member 10 is releasably attached. Specifically, the right and left legs 12 and 14 of the yoke member 10 are tubular members and the latch operating assembly 32 includes a cylindrical rod 34 located within the right leg 12. An eye 36 defines a forward end of the rod 34 and is pivotally fastened, as by a bolt 38 and cotter pin 40, to an outer end of a crank arm 41 welded to and extending upwardly from the latch pivot pin 24.

Figure 2:
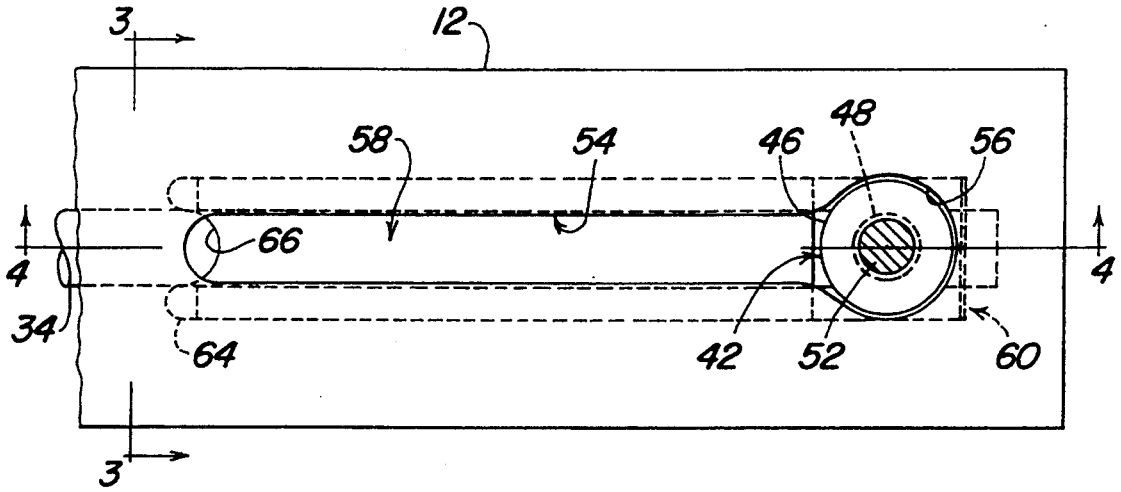
FIG. 2 is a view taken looking normal to the top of the rear end portion of the right leg of the loader yoke member, but with the latch handle removed, and showing the leaf spring resisting movement of the cylindrical lock member, carried at the rear end of the actuator rod, from its locked position in the enlarged rear end of the slot, this locked position corresponding to the closed position of the latch.
Figure 5:
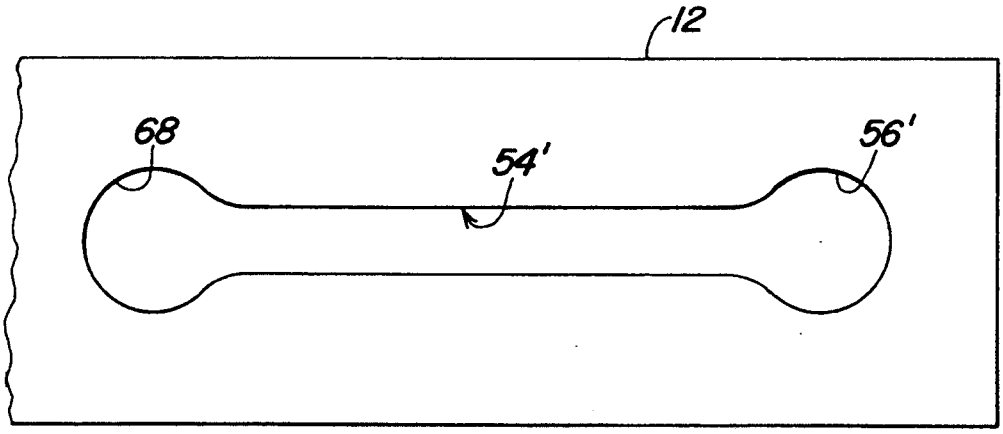
FIG. 5 shows a variation of the slot wherein its forward end is also defined by an enlarged cylindrical portion adapted for receiving the enlarged upper end portion of the cylindrical lock member of the latch actuator rod for the purpose of retaining the latter in its forward position corresponding to the open position of the loader latch.
Figure 4:
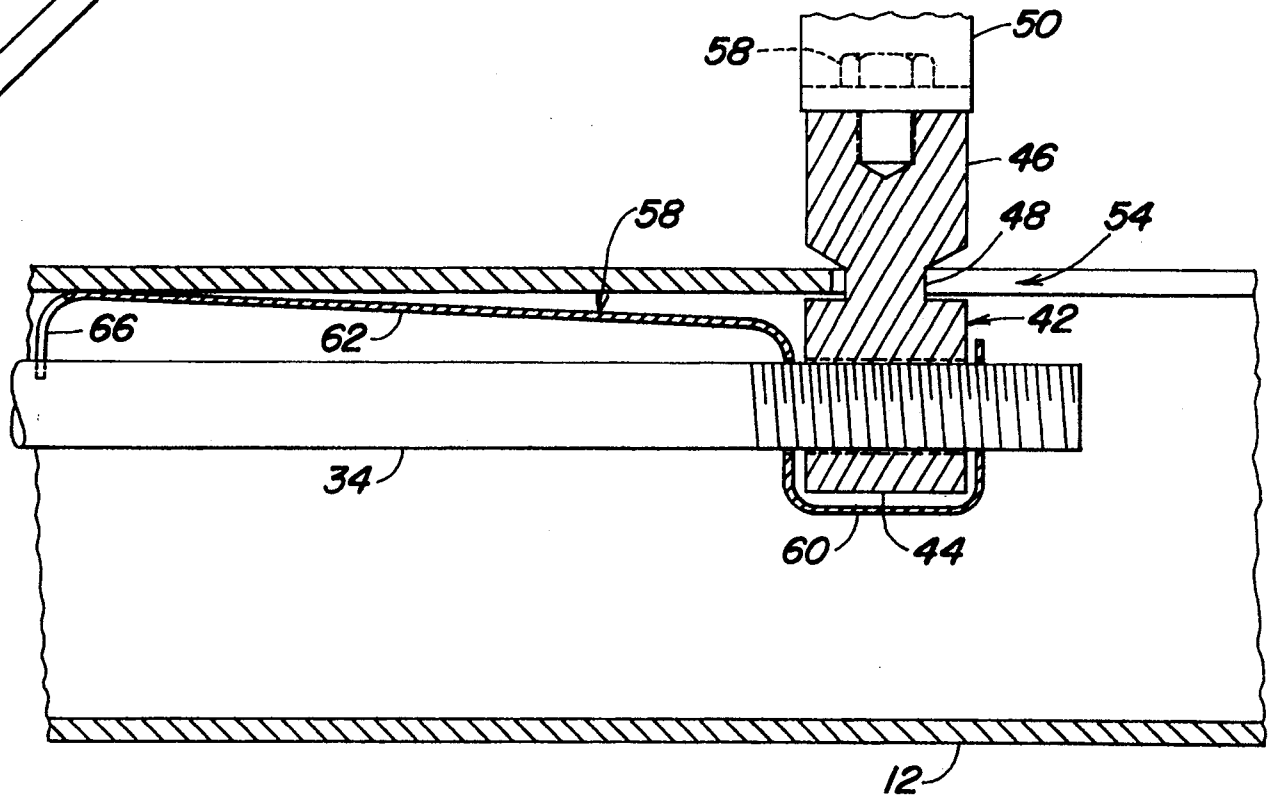
FIG. 4 is a vertical sectional view taken along line 4—4 of FIG. 2 and showing the intermediate necked portion of the lock member of the actuator rod in the forward end of the slot, this position of the rod corresponding to the open position of the loader latch.
Figure 3:
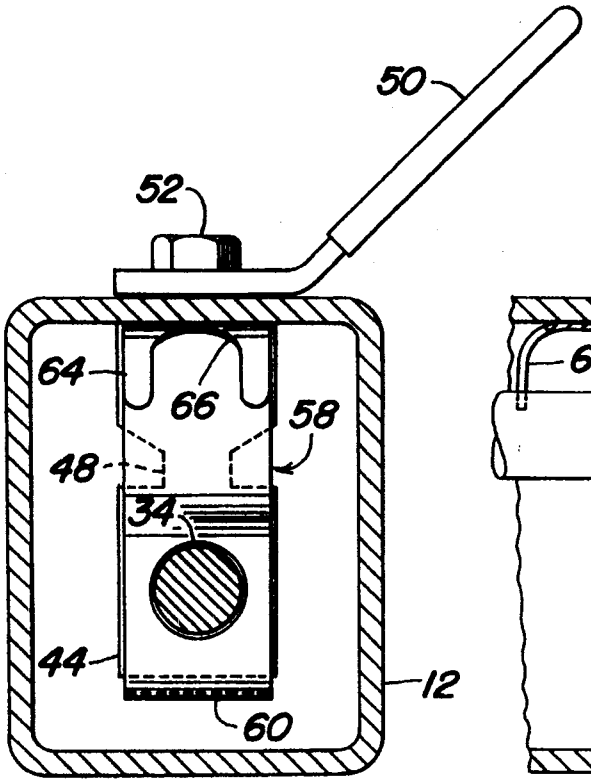
FIG. 3 is a vertical sectional view taken along line 3—3 of FIG. 2.

Referring now also to FIGS. 2–4, and especially to FIGS. 3 and 4, it can be seen that a cylindrical lock member 42 is attached to the rear end of the rod 34. Specifically, the lock member 42 includes lower and upper sections 44 and 46 joined together by an intermediate necked down section 48, with the lower section 44 having a diameter equal to that of the upper section 46 and being adjustably threaded onto the rear end of the rod 34. A handle 50 in the form of an angled strap is bolted, as at 52, to the top of the lock member 42. The upper side of the right yoke leg 12 is provided with an elongate slot 54 having an enlarged cylindrical rear end portion 56 sized to receive the upper end section 46 of the lock member, the remainder of the slot 54 being sized slightly larger than the diameter of the necked down section 48 so as to permit the latter to move freely therealong. The handle 50 serves to keep the lock member 42 disposed within the slot 54. It will be appreciated that for loaders having other than tubular yoke leg members or other frame members located adjacent the operator station, the slot 54 could be placed in any convenient surface of such leg or frame members. When the latch 18 is in its closed position, the rod 34 is placed in tension with the lock member 42 being positioned in a locked position with its upper end section 46 located in the enlarged rear end portion 56 of the slot 54.

The weight of the rod 34 and lock member 42 may generally be relied upon to keep the upper end of the lock member in its locked position. However, if a more positive retention is desired, leaf spring 58 may be mounted on the rod 34 so as to act between the top surface of the yoke member 12 and rod 34 so as to resist upward movement of the lock member 42. Specifically, the rear end of the leaf spring 58 is defined by a U-shape section 60, with the legs of the section 60 being provided with aligned holes receiving the rod 34 and having the lower section 44 of the lock member 42 located therebetween. In its free state, shown in FIGS. 2 and 3, the spring 58 includes a straight intermediate section 62 angled upwardly and forwardly from the front leg of the U-shaped section 60. The spring 58 has a front end defined by a rounded or curved forward section 64 that abuts the upper side of the yoke member 12 and is provided with a clearance notch 66 shaped complimentary to the rod so that when the intermediate section 62 is deflected downwardly, as when the lock member is lifted to place the necked down section 48 in register with the remainder of the slot 54 extending forward from the enlarged slot end 56, as shown in FIG. 4, the rod 34 will enter the notch.

While the leaf spring 58 is the preferred type of biasing member for yieldably retaining the lock member 42 in its latched position, a coil compression spring interposed between the upper side of the yoke member 12 and the lower section 44 of the lock member 42 would also operate to positively retain the lock member in its latched position.

The rod 34 may be removed from the pin 38 and screwed into or out of the lock member 42 if such adjustment is required for the lock member to be placed in its locked position in the rear end of the slot 54 when the latch 18 is in its closed position.

To release the latch 18 and permit it to move to its open position, it is necessary only to lift on the handle 50 to raise the lock member 42 up to dispose the necked down section 48 in the plane of the slot 54 and shift the lock member forwardly so as to shift the rod 34 forwardly to cause the latch 18 to pivot to its open position. When the yoke leg 12 is inclined downwardly as shown in the afore-mentioned application Ser. No. 08/110,144 filed 23 Aug. 1993, the weight of the latch 18, rod 34 and lock member 42 will act to keep the lock member at the forward end of the slot 54. However, if the geometry of the loader is such that the legs of the yoke approach horizontal, it may be desirable to provide a slot 54', shown in FIG. 6, which, in addition to an enlarged rear end portion 56', includes a similarly enlarged forward end portion 68 for receiving the upper section 46 of the lock member 42.

Thus, it will be appreciated that the slot 54 and lock member 42 cooperate to provide an effective means for locking the latch 18 in its closed position and for letting the operator visually discern when the latch 18 is in its closed position. Further, the effective length of the rod 34 may be adjusted by screwing it into or out of the lock member 42 to ensure that the latch 18 is closed when the upper end section 46 of the lock member 42 is in its locked position in the enlarged rear end portion of the slot 54 or 54'.

While the latch operating assembly 32 is used together with a latch for selectively locking a loader yoke member to the weight bracket of a tractor, it should be understood that the assembly 32 may be used together with any element mounted for movement between first and second locations from a remote location where it is impossible to see the position of the element being moved.

We claim:

1. In a mechanism including an element movable between first and second desired positions and having a first end of an elongate rod attached thereto for effecting such movement of the element from a remote location adjacent a second end of said rod, the improvement comprising: a fixed member extending at least along side said second end of said rod; a slot being located in said fixed member in substantial parallel relationship to said rod at said remote location, said slot having an enlarged end located farther from said element than an adjoining portion of the slot; said rod being operable in tension to move said element from said second to said first position; and a lock member being secured to said second end of said rod, having an end section dimensioned for fitting in said at least one enlarged end of said slot but being too large for fitting in said adjoining portion of the slot and having a necked down section located between the rod and said end section and dimensioned for fitting in said adjoining portion of said slot; and said lock member being located such that the end section thereof may be placed in a lock position in said enlarged end of the slot when the element is in its first position so as to lock the element in its first position.

2. The mechanism defined in claim 1 wherein said lock member is threaded onto said second end of the rod so as to adjust the effective length of the rod for ensuring that the lock member will be positioned for movement into the enlarged end of the slot when the element is in its first position.

3. The mechanism defined in claim 1 wherein said enlarged end of the slot is cylindrical and said lock member being cylindrical.

4. The mechanism defined in claim 1 wherein a biasing means is mounted for acting between said fixed member and a location, adjacent said lock member, of an assembly comprising said rod and lock member, said biasing means acting for resisting movement of said lock member from said lock position.

5. In a tractor-mounted loader including a U-shaped yoke member having a bight portion joining forward ends of opposite yoke legs and carrying a latch of L-shaped cross section mounted for pivotal movement about a horizontal transverse axis and being selectively movable, through means of an actuator assembly including a rod extending along one of the legs, between closed and open positions, the improvement comprising: means coupling a forward end of said rod to said latch so as to effect forward pivoting movement of said latch from said closed position in response to forward movement of said rod and to effect rearward pivoting movement of said latch from said open position in response to rearward movement of said rod; said actuator assembly further including a lock member mounted to a rear end of said rod; a fore-and-aft extending slot being located in said one of the legs and including a enlarged rear end portion; and said lock member having first and second sections respectively of a cross sections complimentary to said enlarged rear end portion of said slot and to an adjoining portion of said slot extending forwardly from said enlarged rear end portion; said first section of said lock member being selectively locatable in said enlarged rear end portion of said slot to establish a locked condition in said rod corresponding said closed position of said latch, the second section of the lock member being registrable with said adjoining portion of slot for movement to a forward end thereof to establish an unlocked condition corresponding to the open position of said latch.

6. The tractor-mounted loader defined in claim 5 wherein said rod is releasably attached to said latch and is adjustably threaded into said lock member whereby the effective length of the rod may be adjusted, after being detached from the latch, to ensure that the latch is in its closed position when the latch member is positioned with its first section in said enlarged rear end portion of said slot.

7. The tractor-mounted loader defined in claim 5 wherein said one leg is hollow, said rod is located within said one leg and said slot is located on a top side of said leg.

8. The tractor-mounted loader defined in claim 5 wherein said lock member is cylindrical.

9. The tractor-mounted loader defined in claim 5 wherein a handle is coupled to said first section of the lock member and is dimensioned for preventing the lock member from escaping from the slot in a direction away from the handle.

10. The tractor-mounted loader defined in claim 5 and further including a biasing means mounted for acting between said one leg of the yoke member and a location, in the vicinity of said lock member, of an assembly comprising said rod and lock member for resiliently resisting movement of said second section of the lock member into register with said adjoining portion of the slot when the lock member is in its locked position.

11. The tractor-mounted loader defined in claim 10 wherein said biasing means is a leaf spring having a rear end defined by a U-shaped section mounted to said rod and a further section extending forwardly and upwardly from a forward leg of said U-shaped section, with said further section contacting said one leg of the yoke member.

12. The tractor-mounted loader defined in claim 5 wherein said slot includes an enlarged forward end portion dimensioned identically to said enlarged rearward end portion; and said first section of said lock member being movable into said enlarged forward end portion to establish a second locked position corresponding to the open position of said latch.

* * * * *